US010137476B2

(12) United States Patent
Richert et al.

(10) Patent No.: US 10,137,476 B2
(45) Date of Patent: Nov. 27, 2018

(54) COATING AGENT FOR CORROSION-RESISTANT COATINGS

(71) Applicant: BASF Coatings GmbH, Münster (DE)

(72) Inventors: Michael Richert, Emsdetten (DE); Wolfgang Duschek, Münster (DE); Michael Dornbusch, Lüdenscheid (DE)

(73) Assignee: BASF Coatings GmbH, Münster (DE)

( * ) Notice: Subject to any disclaimer, the term of this patent is extended or adjusted under 35 U.S.C. 154(b) by 162 days.

(21) Appl. No.: 15/054,923

(22) Filed: Feb. 26, 2016

(65) Prior Publication Data

US 2016/0175886 A1 Jun. 23, 2016

Related U.S. Application Data

(62) Division of application No. 13/146,024, filed as application No. PCT/EP2010/000148 on Jan. 14, 2010, now abandoned.

(30) Foreign Application Priority Data

Feb. 5, 2009 (DE) ..... 10 2009 007 632

(51) Int. Cl.
*B05D 7/00* (2006.01)

(52) U.S. Cl.
CPC ..... *B05D 7/57* (2013.01); *B05D 2202/00* (2013.01); *Y10T 428/31504* (2015.04); *Y10T 428/31681* (2015.04); *Y10T 428/31786* (2015.04); *Y10T 428/31855* (2015.04)

(58) Field of Classification Search
CPC ..... B05D 2202/00; B05D 7/57; Y10T 428/31504; Y10T 428/31681; Y10T 428/31786; Y10T 428/31855
See application file for complete search history.

(56) References Cited

U.S. PATENT DOCUMENTS 3,301,783 A * 1/1967 Dickson ..... B01F 17/0042 508/225
3,494,847 A * 2/1970 Morris ..... C08G 63/914 204/498
3,922,253 A 11/1975 Jerabek et al.
3,964,936 A 6/1976 Das
4,017,438 A 4/1977 Jerabek et al.
4,038,232 A 7/1977 Bosso et al.
4,101,486 A 7/1978 Bosso et al.
4,104,147 A 8/1978 Marchetti et al.
4,148,772 A 4/1979 Marchetti et al.
4,252,703 A 2/1981 Patzschke et al.
4,557,976 A 12/1985 Geist et al.
4,828,826 A 5/1989 Franz et al.
4,830,722 A 5/1989 Dobbelstein et al.
4,939,213 A 7/1990 Jacobs, III et al.
4,939,215 A 7/1990 Mueller et al.
5,003,025 A 3/1991 Dobbelstein et al.
5,045,616 A 9/1991 Rauterkus et al.
5,066,732 A 11/1991 Savino et al.
5,084,541 A 1/1992 Jacobs, III et al.
5,196,487 A 3/1993 Kogure et al.
5,221,371 A 6/1993 Miller
5,244,649 A 9/1993 Ostertag et al.
5,338,434 A 8/1994 Ruhl et al.
5,494,535 A 2/1996 Keller et al.
5,567,761 A 10/1996 Song
6,312,812 B1 11/2001 Hauser et al.
6,319,987 B1 11/2001 White et al.
7,388,044 B2 6/2008 McGee et al.
8,399,061 B2 3/2013 Dornbusch et al.
8,475,883 B2 7/2013 Dornbusch
2002/0096230 A1 7/2002 Hardin et al.
2003/0072950 A1 4/2003 Rodrigues et al.
2003/0082391 A1 5/2003 Goodreau et al.
2003/0130471 A1 7/2003 Grandhee
(Continued)

FOREIGN PATENT DOCUMENTS

CN 1162322 10/1997
DE 2701002 7/1977
(Continued)

OTHER PUBLICATIONS

English Translation of International Preliminary Report on Patentability for International Application No. PCT/EP2006/003545 dated Dec. 6, 2007.
English Translation of International Preliminary Report on Patentability for International Application No. PCT/EP2007/008132 dated Jun. 10, 2009.
English Translation of International Preliminary Report on Patentability for International Application No. PCT/ EP2007/008136 dated Jul. 16, 2009.
English Translation of International Preliminary Report on Patentability for International Application No. PCT/ EP2007/010945 dated Oct. 6, 2009.
(Continued)

*Primary Examiner* — Kevin R Kruer
(74) *Attorney, Agent, or Firm* — Servilla Whitney LLC

(57) ABSTRACT

The invention relates to a multicoat color and/or effect paint system comprising, lying above one another in this order, (1) at least one first basecoat comprising basecoat material (A),
(2) preferably a second color and/or effect basecoat comprising basecoat material (B), and
(3) optionally at least one transparent coating comprising clearcoat material (C), wherein the basecoat material (A) forming the first basecoat comprises at least one binder (a.1), at least one color and/or effect pigment (a.2), and at least one water-soluble or water-dispersible, oligomeric or polymeric component (a.3) which comprises a parent structure (GK) having at least two repeating monomer units (ME) and also at least one uni- and/or multidentate, potentially anionic ligand (L) which is still capable of forming complexes after the multicoat paint system has been thermally cured.

11 Claims, No Drawings

(56) References Cited

U.S. PATENT DOCUMENTS

| | | | |
|---|---|---|---|
| 2003/0187145 | A1 | 10/2003 | Martin et al. |
| 2004/0143035 | A1 | 7/2004 | Goebelt et al. |
| 2005/0096438 | A1 | 5/2005 | Chang et al. |
| 2005/0112235 | A1 | 5/2005 | Shefer et al. |
| 2005/0238789 | A1 | 10/2005 | Cholli et al. |
| 2008/0022027 | A1 | 1/2008 | Tsuboi |
| 2008/0193662 | A1 | 8/2008 | Dornbusch |
| 2009/0075063 | A1 | 3/2009 | Iida et al. |
| 2009/0123742 | A1 | 5/2009 | Vandermeulen et al. |
| 2010/0065157 | A1 | 3/2010 | Dornbusch |
| 2010/0098842 | A1 | 4/2010 | Dornbusch |
| 2012/0100394 | A1 | 4/2012 | Dornbusch |
| 2012/0128885 | A1 | 5/2012 | Dornbusch |
| 2012/0128989 | A1 | 5/2012 | Richert |
| 2012/0135245 | A1 | 5/2012 | Richert |
| 2013/0217884 | A1 | 8/2013 | Masumoto et al. |
| 2013/0288050 | A1 | 10/2013 | Arruda et al. |

FOREIGN PATENT DOCUMENTS

| | | |
|---|---|---|
| DE | 3518732 | 11/1986 |
| DE | 3518770 | 11/1986 |
| DE | 3636183 | 3/1988 |
| DE | 3718446 | 12/1988 |
| DE | 3719804 | 3/1989 |
| DE | 3727382 | 3/1989 |
| DE | 3930601 | 3/1991 |
| DE | 4119383 | 12/1991 |
| DE | 4438504 | 5/1996 |
| DE | 19612899 | 10/1997 |
| DE | 3636156 | 4/1998 |
| DE | 19645761 | 5/1998 |
| DE | 19722862 | 1/1999 |
| DE | 19858708 | 6/2000 |
| DE | 19948004 | 7/2001 |
| DE | 10005113 | 8/2001 |
| DE | 10039262 | 2/2002 |
| DE | 10126651 | 12/2002 |
| DE | 10206983 | 9/2003 |
| DE | 10256226 | 6/2004 |
| DE | 10300751 | 7/2004 |
| DE | 10310972 | 9/2004 |
| DE | 10322446 | 12/2004 |
| DE | 10330413 | 1/2005 |
| DE | 10-2005-023728 | 11/2006 |
| DE | 10-2005-023729 | 11/2006 |
| DE | 10-2006-053291 | 5/2008 |
| DE | 10-2007-012406 | 9/2008 |
| DE | 4437535 | 4/2015 |
| EA | 0265820 | 10/1987 |
| EP | 0004090 | 9/1979 |
| EP | 0012463 | 6/1980 |
| EP | 0068311 | 1/1983 |
| EP | 0264843 | 4/1988 |
| EP | 0283852 | 9/1988 |
| EP | 0293746 | 12/1988 |
| EP | 0319017 | 6/1989 |
| EP | 0269828 | 3/1991 |
| EP | 0417567 | 3/1991 |
| EP | 0522419 | 1/1993 |
| EP | 0522420 | 1/1993 |
| EP | 0593454 | 4/1994 |
| EP | 0608021 | 7/1994 |
| EP | 0528853 | 9/1994 |
| EP | 0726919 | 10/1994 |
| EP | 0624577 | 11/1994 |
| EP | 0534120 | 3/1995 |
| EP | 0787159 | 8/1997 |
| EP | 1405933 | 4/2004 |
| EP | 1455002 | 9/2004 |
| EP | 1217094 | 3/2005 |
| EP | 1571237 | 9/2005 |
| FR | 2859999 | 3/2005 |
| JP | H04-25646 | 9/1992 |
| JP | 2002-086613 | 3/2002 |
| WO | WO-01/02501 | 3/1984 |
| WO | WO-95/12695 | 5/1995 |
| WO | WO-96/10461 | 4/1996 |
| WO | WO-96/13537 | 6/1996 |
| WO | WO-96/33814 | 10/1996 |
| WO | WO-98/54266 | 12/1998 |
| WO | WO-99/12661 | 3/1999 |
| WO | WO-99/29927 | 6/1999 |
| WO | WO-01/02457 | 1/2001 |
| WO | WO-01/46296 | 6/2001 |
| WO | WO-01/46495 | 6/2001 |
| WO | WO-01/86016 | 11/2001 |
| WO | WO-02/02665 | 1/2002 |
| WO | WO-02/46518 | 6/2002 |
| WO | WO-02/086000 | 10/2002 |
| WO | WO-03/042275 | 5/2003 |
| WO | WO-03/051990 | 6/2003 |
| WO | WO-03/059971 | 7/2003 |
| WO | WO-2004/085556 | 10/2004 |
| WO | WO-2005/021168 | 3/2005 |
| WO | WO-2005/042801 | 5/2005 |
| WO | WO-2006/062666 | 6/2006 |
| WO | WO-2007/048587 | 5/2007 |
| WO | WO-2007/077584 | 7/2007 |
| WO | WO-2007/125028 | 11/2007 |
| WO | WO-2007/125038 | 11/2007 |
| WO | WO-2008/058587 | 5/2008 |
| WO | WO-2008/110195 | 9/2008 |

OTHER PUBLICATIONS

English Translation of International Search Report for International Application No. PCT/EP2006/0033545 dated Jul. 26, 2006.

English Translation of International Search Report for International Application No. PCT/EP2007/008136 dated Nov. 20, 2007.

English Translation of International Search Report for International Application No. PCT/EP2007/010945 dated Apr. 29, 2008, 2 pages.

English Translation of Written Opinion for International Application No. PCT/EP2006/003545 dated Jul. 26, 2006.

English Translation of Written Opinion for International Application No. PCT/EP2007/008132 dated Feb. 6, 2009.

English Translation of Written Opinion for International Application No. PCT/EP2007/010945 dated Apr. 29, 2008.

English Translation of Zhihu, Guo, et al., Corrosion inhibitors and their applications, pp. 282-285, Press of Lluazhong Institute of Technology.

Final Office Action in U.S. Appl. No. 13/146,024, dated Dec. 2, 2015, 10 pages.

PCT International Search Report in PCT/EP2007/008132 dated Feb. 6, 2009.

Machine English Translation of DE102005023728, first published in German May 2005.

Non-Final Office Action in U.S. Appl. No. 13/146,024, dated May 11, 2015, 6 pages.

Opposition of EP1883679, Title; "Corrosion-protection agent forming a layer of paint and method for current-free application thereof", Patentee: BASF Coatings GmbH, Munster, From: Henkel AG & Co. KGaA, Dusseldorf, Germany, To the European Patent Office, Munich, Dated: Jun. 22, 2011, Reference No. HE 07930EP, 17 pages, English Translation.

PCT International Preliminary Report on Patentability in PCT/EP2009/009270, dated Aug. 9, 2011.

PCT International Preliminary Report on Patentability in PCT/EP2010/000146, dated Aug. 9, 2011.

PCT International Preliminary Report on Patentability in PCT/EP2010/000147, dated Aug. 9, 2011.

PCT International Preliminary Report on Patentability in PCT/EP2010/000148, dated Aug. 9, 2011.

PCT International Preliminary Report on Patentability in PCT/EP2010/000149, dated Aug. 9, 2011.

PCT International Search Report in PCT/EP2009/009270, dated Apr. 23, 2010.

PCT International Search Report in PCT/EP2010/000146, dated May 10, 2010.

(56) References Cited

OTHER PUBLICATIONS

PCT International Search Report in PCT/EP2010/000147, dated May 10, 2010.
PCT International Search Report in PCT/EP2010/000148, dated May 10, 2010.
PCT International Search Report in PCT/EP2010/000149, dated Jul. 7, 2010.
PCT International Written Opinion in PCT/EP2009/009270, dated Apr. 23, 2010.
PCT International Written Opinion in PCT/EP2010/000146, dated May 10, 2010.
PCT International Written Opinion in PCT/EP2010/000147, dated May 10, 2010.
PCT International Written Opinion in PCT/EP2010/000148, dated May 10, 2010.
PCT International Written Opinion in PCT/EP2010/000149, dated Jul. 7, 2010.
PCT International Written Opinion in PCT/EP2007/008136, dated Nov. 20, 2007.
Ma, Tao et al., The Synergistic Effect of Modified Imidazoline Compound and Alkyl-Phosphate/K.KJ Ester As Corrosion Inhibitors, ACTA Petrolei Sinica (Petroleum Procession Section), Oct. 2007, pp. 61-65, vol. 23, No. 5 (English Abstract included.).
Wang, Xinlong, et al., Advancingof Organophosphorus Corrosion Inhibitors, Corrosion & Protection, Aug. 21, 2000, pp. 356-369, vol. 21, No. 8 (English Abstract included.).

* cited by examiner

COATING AGENT FOR CORROSION-RESISTANT COATINGS

CROSS REFERENCE TO RELATED APPLICATIONS

This application is a divisional of U.S. patent application Ser. No. 13/146,024 filed Sep. 13, 2011, which is a National Stage Entry of PCT/EP10/00148 filed Jan. 14, 2010, which claims priority to German Application No. 102009007632.8, filed Feb. 5, 2009, the disclosures of which are incorporated herein by reference in their entireties.

FIELD OF THE INVENTION

The present invention relates to coating compositions for corrosion-stable finishes, more particularly for multicoat color and/or effect paint systems.

BACKGROUND

Modern motor vehicles commonly sport multicoat color and/or effect paint systems. Generally speaking, these multicoat paint systems comprise an electrocoat, a surfacer coat, anti-stonechip primer or functional coat, a color and/or effect basecoat, and a clearcoat. The multicoat paint systems are produced preferably by means of what are called wet-on-wet processes, in which a clearcoat film is applied to a dried, uncured basecoat film, and then at least basecoat film and clearcoat film are jointly cured thermally. This process may also be extended to include the production of the electrocoat and the surfacer coat, anti-stonechip primer or functional coat.

In these systems, the surfacer coats, anti-stonechip primers or functional coats are critical for such essential technological properties as impact resistance and smoothness and leveling of the overall finish. As a consequence, the requirements imposed on the quality of the surfacer coats, anti-stonechip primers or functional coats are particularly exacting. The systems must also be able to be produced easily and with outstanding reproducibility.

The automobile industry is concerned, moreover, to reduce the dry film thicknesses of the surfacer coats, anti-stonechip primers or functional coats, in order to lower the costs of raw materials and energy, without this being accompanied by any deterioration in the profile of performance properties of the multicoat paint systems, and particularly no deterioration in UV stability.

Important contributions towards solving these problems have been provided by the processes known from patent applications DE 44 38 504 A1, WO 2005/021168 A1 and WO 2006/062666 A1. The processes coat a substrate with an electrocoat material. The resulting electrocoat film is baked. The electrocoat is coated with a first, physically or thermally curable, aqueous basecoat material. The resulting first basecoat film, without being fully cured beforehand, is coated with a second, thermally curable, aqueous basecoat material. The resulting second basecoat film, without being fully cured beforehand, is coated with a clearcoat material, to produce a clearcoat film. Subsequently the first and second basecoat films and the clearcoat film are jointly baked.

The first, physically or thermally curable, aqueous basecoat material comprises as a binder at least one water-dilutable polyurethane resin, especially acrylated polyurethanes. Components of the first basecoat material may include titanium dioxide as pigment, talc as filler, and UV absorbers. The first basecoat material produces a first basecoat or functional coat, which at dry film thicknesses <35 μm, preferably of about 15 μm, is able to replace the conventional surfacer coats, anti-stonechip primers or functional coats without a loss of key technological properties of the multicoat paint systems. Moreover, the use of UV absorbers, especially UV-absorbing pigments, as described in WO 2005/021168 A1 and WO 2006/062666 A1, ensures that the UV stability of the multicoat paint systems in question is secured.

Where the above-described multicoat paint systems are exposed to stone chipping, there are instances, in spite of their high stonechip resistance, of flaking of the overall coating system, and in such cases the bare metallic substrate is exposed and is subjected to attack by corrosion. This corrosion is manifested in the formation of blisters, which are bubblelike eruptions in the multicoat paint system, accompanied by progressive enlargement of the area exposed by the stone chipping, as a result of the corrosive undermining of the multicoat paint system starting from the corrosion on the bare metallic substrate.

There is therefore a need to develop coating compositions for multicoat paint systems that protect the bare metallic substrate, exposed by impact load, by means of corrosion inhibitors which are already present in the coat system. In this context it is necessary for the corrosion inhibitors to have on the one hand a sufficiently high mobility to reach the exposed metallic substrate and on the other hand to be incorporated effectively in the coat system, in order to prevent unnecessary bleeding in humidity cycles as a result of osmotic pressure.

The corrosion inhibitors that are customarily used in the electrocoat film are pigmentlike and are added with the binder. Low molecular mass corrosion inhibitors can only reach the interface between substrate and paint, and hence be deposited, in the deposition process when they carry a positive charge; corrosion inhibitors of this kind usually have an adverse effect on the properties of the overall paint tank and hence of the finish. However, the particle size of pigmentlike corrosion inhibitors means that they have very little mobility or none at all.

DE 103 00 751 A1 describes coating compositions which can comprise up to 5% by weight, based on the coating composition, of water and/or solvents, and which in accordance with the invention are intended for the direct coating of metals, more particularly for the coating of metal strips, but which may also be applied over an electrocoat film. The coating compositions are cured with actinic radiation and comprise low molecular mass organic corrosion inhibitors and, preferably, further inorganic anticorrosion pigments. Besides the corrosion inhibitors and/or anticorrosion pigments, there may additionally be color pigments present in the coating composition. A multicoat paint system in automotive OEM finishing, as outlined in the introduction, is not described.

Where an electrocoat film is coated, more particularly over electrocoat films in automotive OEM finishing, using a coating composition which is cured with actinic radiation, the electrocoat film is sensitively damaged by photodegradation, leading to significantly reduced adhesion of the electrocoat film and hence to increased corrosive undermining of the coat in the vicinity of the bare metallic substrate—this phenomenon being what the present invention is specifically intended to avoid. Moreover, the application properties of the coating compositions described in DE 103 00 751 A1 can be adapted only with high cost and complexity to the application conditions, particularly with regard to the rheology, of the kind that are necessary for the above-described multicoat paint systems in automotive OEM finishing.

SUMMARY

It was an object of the present invention to provide coating compositions for corrosion-stable coatings, more particularly for multicoat color and/or effect paint systems on preferably metallic substrates, that comprise, lying atop one another in this order, (1) at least one first basecoat comprising basecoat material (A), (2) preferably at least one second basecoat comprising basecoat material (B), and (3) at least one transparent coating comprising clearcoat material (C), producible preferably by successive application of at least one thermally curable, preferably aqueous basecoat material (A), preferably at least one thermally curable, preferably aqueous basecoat material (B), and at least one clearcoat material (C) to an unprimed substrate or, preferably, to a substrate at least partly coated with at least one uncured or partly cured primer (G) or, more preferably, to a substrate at least partly coated with at least one fully cured primer (G), that do not have the disadvantages of the prior art. More particularly the multicoat paint system of the invention ought to exhibit effective adhesion to the adjacent paint coats, and also, in particular, ought to exhibit significantly reduced corrosion after chipping exposure, initiated by corrosive undermining of the multicoat system starting from exposed bare metallic substrate. Furthermore, the improvement in corrosion resistance ought more particularly to be achieved with components which can be incorporated effectively in the basecoat material (A). Further, the intention is that the physically or thermally curable, preferably aqueous basecoat material (A) can be provided in a simple way on the basis of commercially customary, preferably aqueous, basecoat materials, and provide first basecoats which even at a coat thickness of about 15 pm are able fully to replace conventional surfacer coats, anti-stonechip primers or functional coats, without any adverse effect on the performance properties of the multicoat paint systems, more particularly the stonechip protection and the UV stability even after long-term exposure. The new process ought to be able to be carried out on existing lines for the application of basecoat materials, by electrostatic spray application and pneumatic application, without necessitating conversions.

Found accordingly have been a multicoat color and/or effect paint system on substrates, comprising, lying atop one another in this order, (1) at least one first color and/or effect basecoat comprising basecoat material (A), (2) preferably at least one second, color and/or effect basecoat comprising basecoat material (B), and (3) at least one transparent coating comprising clearcoat material (C), producible preferably by successive application of at least one thermally curable aqueous basecoat material (A), at least one thermally curable aqueous basecoat material (B), and, where appropriate, of at least one clearcoat material (C) to an unprimed or, preferably, to a substrate coated with at least one uncured or partly cured primer (G) or, with particular preference, to a substrate at least partly coated with at least one fully cured primer (G) and joint curing (a) of the resulting wet films of the basecoat materials (A) and (B) and, where appropriate, of the clearcoat material (C), or (b) of the basecoat materials (A) and (B) and, where appropriate, of the clearcoat material (C) and also, where appropriate, the uncured or partly cured primer (G), in which the basecoat material (A) comprises (a.1) at least one binder, (a.2) at least one color or effect pigment, and (a.3) at least one water-soluble or water-dispersible oligomeric or polymeric component which comprises a parent structure (GK) with at least two repeating monomer units (ME), and also at least one uni- and/or multidentate, potentially anionic ligand (L) having electron-donor capacity which, when the multicoat paint system is thermally cured, does not lose its capacity as a chelating agent.

In light of the prior art it was unforeseeable for the skilled worker that the problems addressed by the present invention, of reducing the corrosion after chipping exposure in combination at the same time with ready incorporability of component (a.3) into the coating composition of the invention, could be achieved by means of the multicoat paint system of the invention. The coating composition of the invention produced first basecoats (A) which, even at a film thickness of about 15 μm, were able fully to replace conventional surfacer coats, anti-stonechip primers or functional coats, without adversely affecting the performance properties of the multicoat paint systems, such as, more particularly, the effective adhesion to the adjacent coating films, and also the stonechip protection and UV stability even after long-term exposure. At the same time it was possible to implement the coating composition of the invention on existing lines for the application of basecoat materials by electrostatic spray application and pneumatic spray application, without necessitating conversions.

DETAILED DESCRIPTION

The Binder (a.1)

The preferably thermally curable and with particular preference aqueous basecoat material (A) which is used for the multicoat paint system described below, comprises as an essential constituent at least one binder (a.1) which preferably has functional groups (Gr). Particularly preferred functional groups (Gr) are hydroxyl, carbamate, epoxy, amino and/or isocyanate groups, with hydroxyl groups being most particularly preferred as functional groups (Gr). It is possible in this context, in principle, to use all thermally curable binders having such features that are known for use in organic and/or aqueous basecoat materials.

Suitable binders (a.1) for use in the coating compositions of the invention are described in, for example, patent applications DE 44 38 504 A1, EP 0 593 454 B1, DE 1 99 48 004 A1, EP 0 787 1 59 B1, and WO 2005/021 168 A1. Preference is given to using the binders described in EP 0 593 454 B1, EP 0 787 1 59 B1, DE 1 99 48 004 A1 and/or WO 2005/021 1 68 A1, it being possible to use further binders in addition to these binders.

Preferably the binders (a.1) comprise combinations of at least 2 components selected from the group of preferably water-dilutable polyester resins (a. 1.1), preferably water-dilutable polyurethane resins (a. 1.2) and/or preferably water-dilutable polyacrylate resins (a. 1.3).

As component (a. 1.1) it is particularly preferred to use the water-dilutable polyester resins that are described in EP 0 593 454 B1, page 8 line 3 to page 9 line 42. Such polyester resins (a.1.1) are obtainable by reacting (a.1.1.1) polyols or a mixture of polyols and (a.1.1.2) polycarboxylic acids or polycarboxylic anhydrides or a mixture of polycarboxylic acid and/or polycarboxylic anhydrides to give a polyester resin having an acid number to DIN EN ISO 3682 of 20 to 70, preferably 25 to 55 mg KOH/g nonvolatile fraction and a hydroxyl number to DIN EN ISO 4629 of 30 to 200, preferably 45 to 100 mg KOH/g nonvolatile fraction.

The components (a.1.1.1) that are used with preference for preparing the water-dilutable polyester resins (a.1.1) are described in EP 0 593 454 B1 at page 8 lines 26 to 51, the components (a.1.1.2) used with preference in EP 0 593 454 B1 at page 8 line 52 to page 9 line 32. The preparation of the polyester resins (a.1.1) and their neutralization are described in EP 0 593 454 B1 at page 9 lines 33 to 42.

As component (a.1.2) it is particularly preferred to use the water-dilutable polyurethane resins that are described in EP 0 593 454 B1 at page 5 line 42 to page 8 line 2. Such polyurethane resins (a.1.2) are obtainable by reacting (a.1.2.1) a polyester- and/or polyether polyol or a mixture of such polyester and/or polyether polyols, (a.1.2.2) a polyisocyanate or a mixture of polyisocyanates, (a.1.2.3) a compound which in the molecule contains at least one group which is reactive toward isocyanate groups, and at least one group which is capable of forming anions, or a mixture of such compounds, (a.1.2.4) if desired, at least one hydroxyl- and/or amino-containing organic compound having a molecular weight Mw of 40 to 600 daltons or a mixture of such compounds, and (a.1.2.5) if desired, a compound which contains in the molecule at least one group which is reactive toward isocyanate groups, and at least one polyoxyalkylene group, or a mixture of such compounds with one another and subjecting the resulting reaction product to at least partial neutralization. The polyurethane resin thus prepared preferably has an acid number to DIN EN ISO 3682 of 10 to 60 mg KOH/g nonvolatile fraction and a hydroxyl number to DIN EN ISO 4629 of 5 to 200, preferably 10 to 150 mg KOH/g nonvolatile fraction.

The components (a.1.2.1) used with preference for preparing the water-dilutable polyurethane resins (a.1.2) are described in EP 0 593 454 B1 at page 6 lines 6 to 42; the components (a.1.2.2) used with preference in EP 0 593 454 B1 at page 6 line 43 to page 7 line 13, very particular preference being given to using polyisocyanates based on isophorone diisocyanate and tetramethylxylene diisocyanate; the components (a.1.2.3) used with preference in EP 0 593 454 B1 at page 7 lines 14 to 30; the components (a.1.2.4) used with preference in EP 0 593 454 B1 at page 7 lines 31 to 53; and the components (a.1.2.5) used with preference in EP 0 593 454 B1 at page 7 lines 54 to 58. The preparation of the polyurethane resins (a.1.1) and their neutralization are described in EP 0 593 454 B1 at page 7 line 59 to page 8 line 2.

As component (a.1.3) it is possible to use water-dilutable polyacrylate resins of the kind described in, for example, EP 0 593 454 B1. Preferred as components (a.1.3) are water-dilutable polyacrylate resins which are prepared in the presence of polyurethane prepolymers (a.1.3.1) which if desired contain units with polymerizable double bonds.

One preferred embodiment of the invention uses water-dilutable, polyurethane-modified polyacrylates (a.1.3) according to EP 0 787 159 B1. Water-dilutable, polyurethane-modified polyacrylates (a.1.3) of this kind are obtainable in a preferred embodiment by polymerizing in a first stage, in the presence of a solution of a polyurethane prepolymer (a.1.3.1) which essentially contains no polymerizable double bonds, a mixture of (a.1.3.a.1) a substantially carboxyl-free (meth)acrylic ester or a mixture of (meth)acrylic esters, (a.1.3.a.2) an ethylenically unsaturated monomer which has at least one hydroxyl group per molecule and is substantially carboxyl-free, or a mixture of such monomers, and (a.1.3.a.3) a substantially carboxyl-free monomer different from (a.1.3.a.1) and (a.1.3.a.2), or a mixture of such monomers, the polyurethane prepolymer (a.1.3.1) not being a cross-linked polyurethane resin, and subsequently, in a second stage, following addition of a mixture of (a.1.3.b.1) an ethylenically unsaturated monomer which carries at least one carboxyl group per molecule, or a mixture of such monomers, and (a.1.3.b.2) a substantially carboxyl-free, ethylenically unsaturated monomer or a mixture of such monomers, continuing polymerization after at least 80% by weight of the monomers added in the first stage have undergone reaction, and in a concluding stage, after the end of the polymerization, neutralizing the polyurethane-modified polyacrylate (a.1.3), and subsequently dispersing it in water.

The nature and amount of the monomeric components (a.1.3.a.1), (a.1.3.a.2), (a.1.3.a.3), (a.1.3.b.1), and (a.1.3.b.2) are selected such that the polyacrylate resin obtained from the aforementioned components has an acid number to DIN EN ISO 3682 of 20 to 100 mg KOH/g nonvolatile fraction and a hydroxyl number to DIN EN ISO 4629 of 5 to 200, preferably 10 to 150 mg KOH/g nonvolatile fraction. The preferred weight fractions of the aforementioned components are described in EP 0 787 159 B1 at page 3 lines 4 to 6.

The components (a.1.3.1) used with preference for preparing the water-dilutable, polyurethane-modified polyacrylate resins (a.1.3) are described in EP 0 787 159 B1 at page 3 line 38 to page 6 line 13; the components (a.1.3.a.1) used with preference in EP 0 787 159 B1 at page 3 lines 13 to 20; the components (a.1.3.a.2) used with preference in EP 0 787 159 B1 at page 3 lines 21 to 33; the components (a.1.3.a.3) used with preference in EP 0 787 159 B1 at page 3 lines 34 to 37; the components (a.1.3.b.1) used with preference in EP 0 787 159 B1 at page 6 lines 33 to 39; and the components (a.1.3.b.2) used with preference in EP 0 787 159 B1 at page 6 lines 40 to 42.

A further embodiment of the invention uses water-dilutable, polyurethane-modified polyacrylates (a.1.3), which are prepared in the presence of polyurethane prepolymers (a.1.3.1) which contain units with polymerizable double bonds. Graft copolymers of this kind, and their preparation, are known from, for example, EP 0 608 021 A1, DE 196 45 761 A1, DE 197 22 862 A1, WO 98/54266 A1, EP 0 522 419 A1, EP 0 522 420 A2, and DE 100 39 262 A1.

It is preferred in this context, as water-dilutable, polyurethane-modified polyacrylates (a.1.3) based on graft copolymers, to use those of the kind described in DE 199 48 004 A1. In this context the polyurethane prepolymer component (a.1.3.1) is prepared by reacting (1) at least one polyurethane prepolymer which contains at least one free isocyanate group with (2) at least one adduct which is obtainable by reacting at least one ethenylarylene monoisocyanate and at least one compound containing at least two isocyanate-reactive functional groups with one another in such a way as to leave at least one isocyanate-reactive functional group in the adduct.

The preferred polyurethane prepolymers used in step (1) above are described in DE 199 48 004 A1, page 4 line 19 to page 8 line 4. The preferred adducts used in step (2) above are described in DE 199 48 004 A1, page 8 line 5 to page 9 line 40. The graft copolymerization is preferably carried out, as described in DE 199 48 004 A1, page 12 line 62 to page 13 line 48, with the monomers described in DE 199 48 004 A1, page 11 line 30 to page 12 line 60. For use in the aqueous basecoat material (A) for use in accordance with the invention, the graft copolymer (a.1.3) is partly or fully neutralized, whereby some or all of the potentially anionic groups, i.e., of the acid groups, are converted into anionic groups. Suitable neutralizing agents are known from DE 44 37 535 A1, page 6 lines 7 to 16, or from DE 199 48 004 A1, page 7 lines 4 to 8.

The amount of binder (a.1) in the basecoat material (A) may vary very widely and is guided by the requirements of the case in hand. Preferably the amount of (a.1) in the basecoat material (A), based on the solids of the basecoat material (A), is 10% to 90% by weight, more particularly 15% to 85% by weight.

The Pigment (a.2) of the Basecoat Material (A)

The basecoat material (A) comprises at least one color or effect pigment (a.2). The pigment (a.2) may preferably be selected from the group consisting of organic and inorganic, color-imparting, optical-effect-imparting, color- and optical-effect-imparting, fluorescent, and phosphorescent pigments, more particularly from the group consisting of organic and inorganic, color-imparting, optical-effect-imparting, color- and optical-effect-imparting pigments, or mixtures thereof. With very particular preference the pigment (a.2) has UV-absorbing constituents.

Examples of suitable effect pigments, which may also be color-imparting, are metal flake pigments, such as commercial aluminum bronzes, chromated aluminum bronzes as per DE 36 36 183 A1, and commercial stainless steel bronzes, and also nonmetallic effect pigments, such as, for example, pearlescent pigments and interference pigments, platelet-shaped effect pigments based on iron oxide with shades from pink to brownish red, or liquid-crystalline effect pigments. For further details, refer to Römpp Lexikon Lacke und Druckfarben, Georg Thieme Verlag, 1998, pages 176, "Effect pigments" and pages 380 and 381, "Metal oxide-mica pigments" to "Metal pigments", and to patent applications and patents DE 36 36 156 A1, DE 37 18 446 A1, DE 37 19 804 A1, DE 39 30 601 A1, EP 0 068 311 A1, EP 0 264 843 A1, EP 0 265 820 A1, EP 0 283 852 A1, EP 0 293 746 A1, EP 0 417 567 A1, U.S. Pat. No. 4,828,826 A or U.S. Pat. No. 5,244,649 A.

Examples of suitable inorganic, color-imparting pigments are white pigments such as zinc white, zinc sulfide or lithopones; black pigments such as carbon black, iron manganese black or spinel black; chromatic pigments such as chromium oxide, chromium oxide hydrate green, cobalt green or ultramarine green, cobalt blue, ultramarine blue or manganese blue, ultramarine violet or cobalt violet and manganese violet, red iron oxide, cadmium sulfoselenide, molybdate red or ultramarine red; brown iron oxide, mixed brown, spinel phases and corundum phases or chromium orange; or yellow iron oxide, nickel titanium yellow, chromium titanium yellow, cadmium sulfide, cadmium zinc sulfide, chromium yellow or bismuth vanadate.

Examples of suitable organic, color-imparting pigments are monoazo pigments, disazo pigments, anthraquinone pigments, quinacridone pigments, quinophthalone pigments, diketopyrrolopyrrole pigments, dioxazine pigments, indanthrone pigments, isoindoline pigments, isoindolinone pigments, azomethine pigments, thioindigo pigments, metal complex pigments, perinone pigments, perylene pigments, phthalocyanine pigments or aniline black.

For further details, refer to Römpp Lexikon Lacke und Druckfarben, Georg Thieme Verlag, 1998, pages 180 and 181, "Iron blue pigments" to "Black iron oxide", pages 451 to 453, "Pigments" to "Pigment volume concentration", page 563, "Thioindigo pigments", page 567, "Titanium dioxide pigments", pages 400 and 467, "Naturally occurring pigments", page 459, "Polycyclic pigments", page 52, "Azomethine pigments", "Azo pigments", and page 379, "Metal complex pigments".

Examples of fluorescent and phosphorescent pigments (daylight-fluorescent pigments) are bis(azomethine) pigments.

The amount of the pigments (a.2) in the basecoat material (A) may vary very widely and is guided primarily by the intensity of the effects, more particularly of the optical effects, and/or by the shade which is or are to be produced.

Preferably the pigments (a.2) are present in the basecoat material (A) in an amount of 0.5% to 60%, more preferably 0.5% to 45%, very preferably 0.5% to 40%, most preferably 0.5% to 35% and in particular 0.5% to 30% by weight, based on the solids of the basecoat material.

To facilitate their incorporation into the coating composition, the pigments (a.2) are preferably dispersed with at least one above-described constituent of the binder (a.1). With particular preference the above-described component (a.1.2) of the binder (a.1) is used for the dispersing.

With particular preference the basecoat material (A) comprises at least one UV-absorbing pigment (a.2.1). The UV-absorbing pigments (a.2.1) are preferably selected from the group consisting of titanium dioxide pigments and carbon black pigments.

The amount of UV-absorbing pigments, in particular of titanium dioxide and/or carbon black pigment (a.2.1) in the basecoat material (A) may vary and is guided by the requirements of the case in hand, more particularly by the degree of transmission of UV radiation which is brought about by the other pigments in the basecoat material (A) and/or in the other coats of the multicoat paint system of the invention. The amount of titanium dioxide pigment (a.2.1) in the basecoat material (A), based on the solids of the basecoat material (A), is preferably 0.1% to 50% by weight, more particularly 0.5% to 40% by weight. The amount of carbon black pigment (a.2.1) in the basecoat material (A), based on the solids of the basecoat material (A), is preferably 0.005% to 5% by weight, more particularly 0.01% to 2% by weight.

The Corrosion-Inhibiting Component (a.3) of the Basecoat Material (A)

The water-soluble or water-dispersible oligomeric or polymeric component (a.3) has a parent structure (GK) having at least two repeating monomer units (ME) and at least one unidentate and/or multidentate, potentially anionic ligand (L) having electron donor capacity, whereby the ligand (L) allows effective adhesion to the metallic substrate, and is able, with the metal ions that are released in the corrosion of the substrate, to form chelates (regarding "chelates", compare Römpp Online, Georg Thieme Verlag, Stuttgart, N.Y., 2005, entry "Chelates"), and, when the multicoat paint system is thermally cured, does not lose its capacity as a chelating agent.

Through complexation and/or occupation of the metal surface, the ligands (L) inhibit the corrosion, by reducing the proportion of the metal surface that is freely accessible for the corrosion, and/or bring about a shift in the electrochemical potential of the half-cell formed at the metal surface. Furthermore, component (a.3) is additionally able, through a buffer effect, to suppress the shift in pH of the aqueous medium, at the interface with the metal, that is necessary for corrosion.

Preferably component (a.3) has a water solubility or water dispersibility of at least 20 g/liter of water, more particularly of at least 50 g/liter of water, and more preferably of at least 80 g/liter of water. Water-solubility or water-dispersibility here means that thermodynamically stable solutions or dispersions of component (a.3) in water are formed. The statement of the water-solubility in g/liter corresponds to the maximum concentration of dissolved component (a.3) in water at room temperature (in this regard compare: Römpp Online, Georg Thieme Verlag, 2008). The statement of the water-dispersibility in g/liter corresponds to the maximum concentration of dispersed component (a.3) in water at room temperature. Water-dispersible in the sense of the invention means that component (a.3), up to a particular concentration in the aqueous phase, forms stable aggregates having an average particle diameter of <500, preferably of <100 nm, and more preferably of <50 nanometers.

If the water-solubility or water-dispersibility is still not sufficient, the parent structure (GK) may be modified hydrophilically in a known way. For this purpose, in particular, ionic and/or nonionic substituents are introduced into the parent structure (GK). In the case of anionic substituents these are, more particularly, carboxylate, sulfonate and/or sulfate groups; in the case of cationic substituents they are ammonium, sulfonium and/or phosphonium groups; and in the case of nonionic groups they are oligo- or polyalkoxylated substituents, more preferably ethoxylated substituents. In certain cases the ligand (L) may also contribute to the hydrophilicization of component (a.3), as is the case, in particular, for the anionic phosphonate groups and for the nonionic oligo- or polyalkoxylated, more preferably ethoxylated, substituents.

Examples of suitable monomer units (ME) for the parent structure (GK) of component (a.3) are optionally hydrophilically modified polyols, which can be reacted with polyacids to form polyesters and with polyisocyanates to form polyurethanes, the polyester or polyurethane parent structures generally having a lower weight-average molecular weight Mw than the binder component (a.1). The weight-average molecular weight Mw (determinable by means of gel permeation chromatography in accordance with standards DIN 55672-1 to -3) of the parent structures (GK) is preferably more than 400 daltons, more preferably more than 500 daltons, and very preferably more than 600 daltons.

Particularly preferred as monomer units (ME) are the following:

- (meth)acrylate units, more particularly in combination with further monomer units, such as, for example, styrene, vinylimidazole, vinylphosphonic acid, acrylic acid, maleic anhydride or maleic acid units,
- alkylenamide and/or arylenamide units,
- alkylene oxide units, more particularly ethylene oxide and/or propylene oxide units, and
- more preferably alkylenimine units, especially ethylenimine units.

The parent structure of component (a.3) contains at least two, preferably at least three, and more particularly at least five of the aforementioned monomer units (ME).

As parent structures (GK) it is especially preferred to use polyethylenimines having weight-average molecular weights Mw of more than 500 daltons, more particularly of more than 600 daltons.

The ligands (L) are preferably selected from the group consisting of

- organophosphorus compounds, such as, in particular, organophosphonates, preferably phosphonates hydroxy-, amino- or amido-functionalized on the organic substituent,
- organosulfur compounds, such as, in particular, functionalized thio compounds such as thiol, polythiol, thiocarboxylic acid, thioaldehyde, thioketone, dithiocarbamate, sulfonamide and/or thioamide compounds, preferably polythiols having at least 2 thiol groups, preferably at least 3 thiol groups, more preferably polyester polythiols having at least 3 thiol groups,
- acylated ureas and thioureas, such as, in particular, benzoylurea compounds and/or benzoylthiourea compounds,
- diamines and/or polyamines, such as, in particular, ethylenediaminetetraacetic acid (EDTA) or preferably amines of higher functionality, such as, for example, Jeffcat® products (Huntsman), such as, in particular, trialkylamines, preferably diaminoalkyl-hydroxyalkylamines, such as, more preferably, N,N-bis(3-dimethylaminopropyl)-N-isopropanolamine (Jeffcat® ZR50),
- quinolines, cholines and/or benzimidazoles, such as, in particular, aminoquinoline compounds and/or mercaptobenzimidazole compounds,
- hydroxy compounds which in particular contain further carbonyl, carboxylic acid, thiocarbonyl and/or imino groups in a sterically favorable position, preferably in 1,3-position, very preferably hydroxyacetophenone,
- carbonyl compounds which, in particular, contain further carbonyl, carboxylic acid, thiocarbonyl and/or imino groups in a sterically favorable position, preferably in 1,3-position, more preferably acetylacetonate compounds,
- carbenes and/or
- acetylene compounds, such as, in particular, propargyl compounds.

With preference the ligands (L) are prepared by reaction of the functional groups of the parent structure (GK) with ligand formers (LB).

Suitable ligand formers (LB) which carry the ligands (L) and further functional groups that react with functional groups of the parent structure (GK) are all compounds having unidentate and/or multidentate, potentially anionic ligands (L) with electron donor capacity, allowing effective adhesion to the metallic substrate, which are able to form chelates with the metal ions that are released when the substrate corrodes, and which do not lose their capacity as chelate formers when the multicoat paint system is thermally cured and are preferably cleaved from the parent structure (GK) in only minor proportions, more particularly in proportions of less than 25 mol %, based on the entirety of the ligands (L).

Especially preferred ligand formers (LB) are the following compounds:

- functionalized organophosphorus compounds, such as, in particular, organophosphonates, preferably phosphonates hydroxy-, amino- or amido-functionalized on the organic substituent, functionalized organosulfur compounds, such as, in particular, functionalized thio compounds such as thiol, polythiol, thiocarboxylic acid, thioaldehyde, thioketone, dithiocarbamate, sulfonamide and/or thioamide compounds, preferably polythiols having at least 2 thiol groups, preferably at least 3 thiol groups, more preferably polyester polythiols having at least 3 thiol groups, acylated urea compounds and/or thiourea compounds, such as, in particular, benzoylurea compounds and/or benzoylthiourea compounds, functionalized diamino and/or polyamino compounds, such as, in particular, ethylenediaminetetraacetic acid (EDTA) or preferably amines of higher functionality, such as, for example, Jeffcat products (Huntsman), such as, in particular, trialkylamines, preferably diaminoalkyl-hydroxyalkylamines, such as, very preferably, N,N-bis(3-dimethylaminopropyl)-N-isopropanolamine (Jeffcat® ZR50), functionalized quinoline compounds, choline compounds and/or benzimidazole compounds, such as, in particular, aminoquinoline compounds and/or mercaptobenzimidazole compounds, functionalized hydroxy compounds which in particular contain further carbonyl, carboxylic acid thiocarbonyl and/or imino groups in a sterically favorable position, preferably in 1,3-position, very preferably hydroxyacetophenone, functionalized carbonyl compounds which, in particular, contain further carbonyl, carboxylic acid, thiocarbonyl and/or imino groups in a sterically favorable position, preferably in 1,3-position, more preferably acetylacetonate compounds, functionalized carbene compounds, functionalized acetylene compounds, such as, in particular, propargyl compounds, preferably propargyl alcohol.

Component (a.3) is present in the basecoat material (A) preferably in amounts of 0.1% to 20%, preferably 0.2% to 10%, more preferably 0.5% to 5%, by weight, based in each case on the total weight of the basecoat material (A).

The Further Constituents and the Preparation of the Basecoat Material (A)

In a further embodiment of the invention the basecoat material (A) preferably comprises at least one talc component (a.4). The amount of talc (a.4) may vary very widely and is guided by the requirements of the case in hand. The amount of (a.4), based on the solids of the basecoat material (A), is preferably 0.1% to 5% by weight, more particularly 0.5% to 2% by weight.

The basecoat material (A) may further comprise at least one customary and known additive (a.5) in effective amounts. Preferably the additive (a.5) or additives (a.5) is or are selected from the group consisting of crosslinking agents different from component (a.3); of oligomeric and polymeric binders different from the binders (a.1); and also from the following components that are different from components (a.2) to (a.4): organic and inorganic, colored, transparent, and opaque pigments, fillers, and nanoparticles, organic solvents, dryers, antisettling agents, UV absorbers, light stabilizers, free-radical scavengers, deaerating agents, slip additives, polymerization inhibitors, defoamers, emulsifiers, wetting agents, adhesion promoters, flow control agents, film-forming assistants, and also rheology-control additives and flame retardants. Examples of suitable additives (a.5) are described in German patent application DE 199 48 004 A 1, page 14 line 32 to page 17 line 5, amino resins, preferably being present as sole or predominant crosslinking agents, different from component (a.3), in the basecoat material (A), in the amounts described in DE 199 48 004 A1, page 16 lines 6 to 14, of 0.1% to 30%, preferably 0.3% to 20%, more preferably 0.5% to 10%, by weight, based in each case on the total weight of the basecoat material (A).

In terms of method, the preparation of the coating composition of the invention has no peculiarities, but instead takes place preferably by the mixing of the above-described constituents and homogenizing of the resulting mixtures with the aid of customary and known mixing techniques and apparatus such as, in particular, stirred tanks, mills with agitator mechanisms, Ultraturrax, inline dissolvers, static mixers, toothed-wheel dispersers, pressure-release nozzles and/or microfluidizers.

The Application of the Multicoat Paint System of the Invention

The multicoat paint system of the invention can be applied by any customary and known methods of applying liquid coating materials. For the process of the invention for producing the multicoat paint systems, however, it is of advantage if the basecoat material (A) is applied by means of electrostatic spray application (ESTA), preferably with high-speed rotating bells. The basecoat material (A) is applied preferably at a wet film thickness such that the curing of the resultant coating film of the basecoat material (A) results in a dry film thickness of 6 to 25 μm, preferably 7 to 20 μm, more preferably 8 to 18 μm.

In the preferred process for producing multicoat paint systems, the basecoat material (A) is immediately coated with the thermally curable, preferably aqueous, basecoat material (B). With particular preference the basecoat film comprising the coating composition of the invention is first flashed off or dried, but not cured, or only partly cured, in that process, and then coated with the thermally curable, preferably aqueous, basecoat material (B).

The thermally curable, aqueous basecoat material (B) is preferably a customary and known aqueous basecoat material, as known, for example, from patent application WO 2005/021168, page 24 lines 11 to 28.

In one particularly preferred embodiment of the invention the aqueous basecoat material (B), like the basecoat material (A), comprises component (a.3) in amounts of 0.1% to 20%, preferably 0.2% to 10%, more preferably 0.5% to 5%, by weight, based in each case on the total weight of the basecoat material (B).

Although the basecoat material (B) can be applied by any customary and known method of applying liquid coating materials, it is nevertheless of advantage for the process of the invention if it is applied by means of ESTA high-speed rotation. Preferably it is applied at a wet film thickness such that the curing of the resultant basecoat film (B) results in a dry film thickness of 4 to 25 μm, preferably 5 to 15 μm, more preferably 6 to μm.

The basecoat material (A) and the basecoat material (B), are preferably applied at a wet film thickness such that curing results in an overall dry film thickness of basecoat material (A) and basecoat material (B) of in total 10 to 50 μm, preferably 12 to 35 μm, more preferably 14 to 28 μm.

The preferred multicoat paint systems of the invention are produced by successive application of the basecoat material (A), preferably of at least one thermally curable, preferably aqueous, basecoat material (B), and of at least one clearcoat material (C)

(i) to an unprimed substrate, (ii) preferably to a substrate coated with at least one uncured or partly cured primer (G), or (iii) more preferably to a substrate coated with at least one fully cured primer (G)

and joint curing (a) of the resulting wet films of the basecoat material (A), the basecoat material (B), and the clearcoat material (C), or (b) of the resulting wet films of the coating composition of the invention, the basecoat material (B) and the clearcoat material (C), and also, if desired, of the uncured or partly cured primer (G).

Processes of this kind are known from, for example, German patent application DE 44 38 504 A 1, page 4 line 62 to page 5 line 20 and page 5 line 59 to page 6 line 9, and also from German patent application DE 199 48 004 A 1, page 17 line 59 to page 19 line 22 and page 22 lines 13 to 31 in conjunction with table 1, page 21.

In the case of the preferred process of the invention, the coating composed of the basecoat material (A) or, preferably, the basecoat material (B) is coated immediately with the clearcoat material (C). Or it is first flashed off or dried, but not cured, or only partly cured, in the process, and then coated with the clearcoat material (C).

The clearcoat material (C) is a transparent, in particular optically clear coating material which is curable thermally and/or with actinic radiation. Suitable clearcoat materials (C) include all customary and known one-component (1K), two-component (2K) or multicomponent (3K, 4K) clearcoat materials, powder clearcoat materials, powder slurry clearcoat materials, or UV-curable clearcoat materials. The clearcoat material (C) selected for the process of the invention is applied by means of the customary and known application methods, which are adapted to the aggregate state (liquid or powder) of the clearcoat material (C). Suitable clearcoat materials and methods of applying them are known from, for example, patent application WO 2005/021168, page 25 line 27 to page 28 line 23.

The substrates may be composed of any of a very wide variety of materials and combinations of materials. Preferably they are composed at least partly of metals, it being possible for there to be, adjacent to the metallic substrates, polymeric substrates, such as may be the case, for example, with plastic installation components which are joined to the metal body.

With very particular preference the substrates are composed of metals, more particularly of steels.

The intended uses of the substrates may vary greatly. Preferably the substrates are bodies of motor vehicles, especially automobiles, motorbikes, trucks, and buses, and parts thereof; small industrial parts; coils, containers, and articles of everyday use. More particularly the substrates are bodies of automobiles and parts thereof.

As primers (G) it is possible to use all known organic and/or inorganic primers, especially those for metal or plastic. It is preferred to use customary and known electrocoats as primers (G). The electrocoats (G) are produced in a customary and known manner from electrocoat materials that can be deposited electrophoretically, more particularly cathodically. The resulting electrocoat films (G) are preferably cured thermally before the basecoat material (A) is applied. Alternatively they may be merely dried, without curing or with only partial curing, and then are cured jointly with the other films of coating composition of the invention, preferably basecoat material (B), and clearcoat material (C).

In the preferred process of the invention, the applied films of basecoat material (A), basecoat material (B), and clearcoat material (C) are jointly cured thermally. Where the clearcoat material (C) is also curable with actinic radiation as well, there is also an aftercure by exposure to actinic radiation. Where the primer (G) has not yet been cured, it is cured in this process step.

The curing may take place after a certain rest time, also known as evaporation time, between and after the application, where appropriate, of the primer, the basecoat material (A), the basecoat material (B), and also, finally, the clearcoat material (C). The rest time may have a duration of 30 seconds to 2 hours, preferably 1 minute to 1 hour, and more particularly 1 to 45 minutes. It serves, for example, for the flow and degassing of the coating films, or for the evaporation of volatile constituents. The rest time may be supported and/or shortened through the application of elevated temperatures of up to 90° C. and/or through a reduced air humidity <10 g water/kg air, more particularly <5 g/kg air, provided this does not entail any damage or change to the coating films, such as premature complete crosslinking, for instance.

The thermal cure has no peculiarities in terms of the method but instead takes place by the customary and known methods, such as heating in a forced-air oven or irradiation using IR lamps. The thermal curing here may also take place in stages. Another preferred curing method is that of curing with near infrared (NIR radiation).

Particular preference is given to employing a process in which the water constituent is rapidly removed from the wet films. Suitable such methods are described, for example, by Rodger Talbert in Industrial Paint & Powder, 04/01, pages 30 to 33, "Curing in Seconds with NIR", or in Galvanotechnik, volume 90 (11), pages 3098 to 3100, "Lackiertechnik, NIR-Trocknung im Sekundentakt von Flüssig- and Pulverlacken" [Painting technology, NIR drying in seconds of liquid and powder coatings]. Advantageously the thermal curing takes place at a temperature of 50 to 170, more preferably 60 to 165, and more particularly 80 to 150° C. for a time of 1 minute up to 2 hours, more preferably 2 minutes up to 1 hour, and more particularly 3 to 45 minutes.

The resulting coating systems are of outstanding automobile quality. In addition to an outstanding stonechip resistance, they exhibit excellent adhesion to the primer (G) and to the subsequent coating films, and also, in particular, outstanding resistance to corrosive undermining and resultant blister corrosion of the multicoat systems in the vicinity of bare areas such as those produced, in particular, by stone chipping.

EXAMPLES

Preparation Example 1: Aqueous Polyester Resin Solution (a.1.1)

From 898 parts by weight of neopentyl glycol, 946 parts by weight of hexane-1,6-diol, 570 parts by weight of hexahydrophthalic anhydride, 2107 parts by weight of an oligomeric fatty acid (Pripol®1012, Uniqema, dimer content at least 97% by weight, trimer content not more than 1% by weight, monomer content not more than traces), and 946 parts by weight of trimellitic anhydride, in a common solvent, the polyester (a.1.1) was prepared, with an acid number to DIN EN ISO 3682 of 32 mg KOH/g nonvolatile fraction and a hydroxyl number to DIN EN ISO 4629 of 72 mg KOH/g nonvolatile fraction, and was introduced into deionized water and adjusted with dimethylethanolamine to a pH of 7.6 and with further deionized water to a nonvolatiles content of 60.0% by weight.

Preparation Example 2.1: First Aqueous Polyurethane Dispersion (a.1.2.1)

From 2017 parts by weight of hexane-1,6-diol, 1074 parts by weight of isophthalic acid, and 3627 parts by weight of an oligomeric fatty acid (Pripol® 1012, Uniqema, dimer content at least 97% by weight, trimer content not more than 1% by weight, monomer content not more than traces), in a common solvent, a polyester precursor was prepared which had an acid number to DIN EN ISO 3682 of 3 mg KOH/g nonvolatile fraction and a hydroxyl number to DIN EN ISO 4629 of 73 mg KOH/g nonvolatile fraction, and it was adjusted to a nonvolatile fraction of 73.0% by weight. 1891 parts by weight of the polyester precursor were heated in a common solvent with 113 parts by weight of dimethylolpropionic acid, 18 parts by weight of neopentyl glycol, and 517 parts by weight of isophorone diisocyanate, and reaction was carried out to an isocyanate content of 0.8% by weight, based on the initial mass. Thereafter 50 parts by weight of trimethylolpropane were added and the mixture was stirred until free isocyanate groups were no longer detectable. The polyurethane, with an acid number to DIN EN ISO 3682 of 25 mg KOH/g nonvolatile fraction, was introduced into deionized water, the solvent was removed, and, using further deionized water and using dimethylethanolamine, a pH of 7.2 and a nonvolatiles content of 27.0% by weight were set.

Preparation Example 2.2: Second Aqueous Polyurethane Dispersion (a.1.2.2)

From 1173 parts by weight of neopentyl glycol, 1329 parts by weight of hexane-1,6-diol, 2469 parts by weight of isophthalic acid, and 1909 parts by weight of an oligomeric fatty acid (Pripol®1012, Uniqema, dimer content at least 97% by weight, trimer content not more than 1% by weight, monomer content not more than traces), in a common solvent, a polyester precursor was prepared which had an acid number to DIN EN ISO 3682 of 3 mg KOH/g nonvolatile fraction and a hydroxyl number to DIN EN ISO 4629 of 75 mg KOH/g nonvolatile fraction, and it was adjusted to a nonvolatile fraction of 74.0% by weight. 2179 parts by weight of the polyester precursor were heated in a common solvent with 137 parts by weight of dimethylolpropionic acid, 24 parts by weight of neopentyl glycol, and 694 parts by weight of m-tetramethylxylene diisocyanate (m-TMXDI; TMXDI® (Meta), Cytec Ind.), and reaction was carried out to an isocyanate content of 1.35% by weight, based on the initial mass. Thereafter 111 parts by weight of trimethylolpropane were added and the mixture was stirred until free isocyanate groups were no longer detectable. The polyurethane, with an acid number to DIN EN ISO 3682 of 25 mg KOH/g nonvolatile fraction, was introduced into deionized water, the solvent was removed, and, using further deionized water and using dimethylethanolamine, a pH of 7.4 and a nonvolatiles content of 31.5% by weight were set.

Preparation Example 3: Aqueous Dispersion of a Polyurethane-Modified Polyacrylate (a.1.3)

From 922 parts by weight of neopentyl glycol, 1076 parts by weight of hexane-1,6-diol, 1325 parts by weight of isophthalic acid, 3277 parts by weight of an oligomeric fatty acid (Pripol®1012, Uniqema, dimer content at least 97% by weight, trimer content not more than 1% by weight, monomer content not more than traces), in a common solvent, a polyester precursor was prepared which had an acid number to DIN EN ISO 3682 of 3 mg KOH/g nonvolatile fraction and a hydroxyl number to DIN EN ISO 4629 of 78 mg KOH/g nonvolatile fraction, and it was adjusted to a nonvolatile fraction of 73.0% by weight. 4085 parts by weight of the polyester precursor were heated in a common solvent with 186 parts by weight of neopentyl glycol, and 1203 parts by weight of m-tetramethylxylene diisocyanate (TMXDI® (Meta), Cytec Ind.), and reaction was carried out to an isocyanate content of 1.65% by weight, based on the initial mass. Thereafter 214 parts by weight of diethanolamine (2,2'-iminobisethanol) were added and the mixture was stirred until free isocyanate groups were no longer detectable. The polyurethane precursor, with an acid number to DIN EN ISO 3682 of 0.1 mg KOH/g nonvolatile fraction and a hydroxyl number to DIN EN ISO 4629 of 49 mg KOH/g nonvolatile fraction, was adjusted with a common solvent to a nonvolatile fraction of 59.5% by weight. In the presence of 1017 parts by weight of the polyurethane precursor, in a first stage, in a common solvent, a mixture of 1369 parts by weight of n-butyl acrylate, 919 parts by weight of hydroxyethyl acrylate, 581 parts by weight of cyclohexyl methacrylate, and 509 parts by weight of styrene was polymerized using common initiators for free-radical polymerization. Thereafter, in a second stage, a mixture of 273 parts by weight of n-butyl acrylate, 184 parts by weight of hydroxyethyl acrylate, 116 parts by weight of cyclohexyl methacrylate, 225 parts by weight of acrylic acid, and 102 parts by weight of styrene was polymerized using common initiators for free-radical polymerization. The polyurethane-modified polyacrylate, with an acid number to DIN EN ISO 3682 of 33.5 mg KOH/g nonvolatile fraction, was introduced into deionized water and adjusted using dimethylethanolamine to a pH of 7.4 and with more deionized water to a nonvolatiles content of 35.5% by weight.

Preparation Example 4: The Preparation of Component (a.3): Hydroxyacetophenone-Modified Polyethylenimine 10 g ($6.25*10^{-3}$ mol) of a polyethylenimine having an average molecular weight Mw=800 g/mol (Lupasol FG from BASF AG, ratio of primary, secondary, tertiary amino groups (p-s-t): 1:0.9:0.5) were introduced in 100 g of ethanol under a nitrogen atmosphere and at 50° C. over the course of 5 minutes 17.9 g (0.13 mol) of 2'-hydroxyacetophenone were admixed, the mixture being subsequently stirred at this temperature for 4 hours and the product being used without further purification. The solubility of the component (a.3) thus prepared is >100 g/liter of water at room temperature.

Preparation Example 5: Preparation of an Aqueous Basecoat Material (A)

15.0 parts by weight of a paste of a synthetic sodium aluminum silicate with sheet structure from Laporte (3% in water) were mixed with 25.0 parts by weight of the aqueous dispersion of the polyurethane (a.1.2.1) as per Preparation Example 2.1, 3.0 parts by weight of the aqueous solution of the polyester resin (a.1.1) as per Preparation Example 1, 3.3 parts by weight of butyl glycol, 4.8 parts by weight of a commercial melamine resin (Cymel 327 from Cytec), 0.3 part by weight of a neutralizing solution (dimethylethanolamine, 10% strength in water), 4.0 parts by weight of the dispersion of a polyurethane-modified polyacrylate (a.1.3) as per Preparation Example 3, 2.7 parts by weight of isopropanol, 2.4 parts by weight of ethylhexanol, 0.6 part by weight of Nacure 2500 catalyst (para-toluenesulfonic acid, 25% in isopropanol), 10 parts by weight of a carbon black paste (dispersion of 10% lamp black in the aqueous dispersion of the polyurethane (a.1.2.2) as per Preparation Example 2.2), 14 parts by weight of a white paste (dispersion of 50% titanium dioxide in the aqueous dispersion of the polyurethane (a.1.2.2) as per Preparation Example 2.2), 5.4 parts by weight of deionized water, 1.2 parts by weight of a 1:1 mixture of a polyurethane thickener (Nopco DSX 1550 from Henkel) with butyl glycol, 6.3 parts by weight of deionized water, and 2.0 parts by weight of corrosion inhibitor (a.3) as per Preparation Example 4.

Subsequently the basecoat material is adjusted with a commercial rheomat to a spray viscosity of 90-100 mPas/1000 $s^{-1}$.

Example 1: The Production of the Inventive Multicoat Paint Systems and Their Testing Example 1 was carried out using the basecoat material (A) of Preparation Example 5, an aqueous basecoat material (B) (metallic aqueous basecoat Black Sapphire from BASF Coatings AG), likewise containing the component (a.3) of Preparation Example 4 in a fraction of 2% by weight, based on the basecoat material (B), and a commercial one-component clearcoat material (C) (Protect 2 from DuPont).

For the comparative example, Example C1, the basecoat material (A) of Preparation Example 5 and also the above basecoat material (B) (metallic aqueous basecoat Black Sapphire from BASF Coatings AG), in each case without component (a.3), were used.

The substrates used were test panels of galvanized steel that measured 20×20 cm and had been coated in a dry film thickness of 20 μm with a customary and known electrocoat primer (G).

In the case both of Example 1 and of Example C1, first of all the basecoat material (A) of Preparation Example 5 was applied by electrostatic spray application (ESTA) at a wet film thickness such that curing resulted in a dry film thickness of 15 μm. The resulting coat of the basecoat material (A) was left to evaporate for 4 minutes and then coated by pneumatic spray application with the aqueous basecoat material (B) in a wet film thickness such that curing resulted in a dry film thickness of 7 μm. The coating films of basecoat material (A) and basecoat material (B) were dried at 80° C. for 10 minutes. Thereafter the clearcoat material (C) was applied at a wet film thickness such that curing resulted in a dry film thickness of 40 μm. The clearcoat film (C) was left to evaporate for 5 minutes. Subsequently the films of basecoat material (A), basecoat material (B), and clearcoat material (C) were cured in a forced-air oven at 130° C. for 30 minutes.

The adhesion of the coat of the inventive coating composition to the underlying primer (G) and to the coat of basecoat material (B) is excellent.

The test panels were damaged (stonechip simulation) by the following method:

The freshly painted test specimens were required to rest at room temperature for at least 48 hours after the last painting operation before being subjected to bombardment.

The painted test specimens were bombarded using an Erichsen 508 stonechip tester in accordance with DIN 55996-1. The tube passing through the stonechip tester was extended with an aluminum tube (internal diameter 3.4 cm, length 26.3 cm at the top and 27.8 cm at the bottom, and a distance of 2.0-2.3 cm from the test element (the length of the tube section should be adapted to the particular stonechip tester)) in order to direct the bombardment in a defined and targeted way at a delimited circular area. Bombardment took place with 50 g of chilled cast shot, diamond 4-5 mm, from Eisenwerk Würth GmbH, Bad Friedrichshall, with a pressure of 2 bar. In order to extend the bombardment time to about 10 seconds, the shot was introduced into the running stonechip apparatus at a correspondingly slow rate.

Following simulated stonechip exposure, the samples were subjected to an alternating climatic conditions test KWT in accordance with VDA [German Automakers Association] test bulletin 621-415 (February 1982), the test specimens undergoing 15 week-long cycles, with 1 week-long cycle being structured as follows:

Monday:

Salt spray test to DIN ISO 9227

Tuesday to Friday:

Constant climatic conditions at 40° C. to DIN ISO 6270-2KK

Saturday and Sunday:

Regeneration at 23° C. and 50% relative humidity

The corrosion-induced rate of increase in the area originally damaged by stone chipping was determined by image analysis. After 9 weeks, the weekly average rate of increase was calculated.

The results are compiled in Table 1. It can be seen that when the inventive components (a.3) are used, the result is a distinct reduction in the corrosion-induced increase in the damaged area among the samples exposed to simulated stone chipping.

TABLE 1

Results of the alternating climatic conditions tests (KWT)

| | Component (a.3) | KWT: Increase of damaged area in % per week |
|---|---|---|
| Example 1 | Hydroxyacetophenone-modified polyethylenimine | 0.820 |
| Comparative Example C1 | — | 2.300 |

What is claimed is:

1. A multicoat color and/or effect paint system comprising, lying above one another in this order, (1) at least one first basecoat comprising a basecoat material (A);

(2) a second color and/or effect basecoat comprising a basecoat material (B); and (3) at least one transparent coating comprising a clearcoat material (C);

wherein the basecoat material (A) comprises:

(a.1) at least one binder, (a.2) at least one color or effect pigment, and (a.3) at least one water-soluble or water-dispersible, corrosion-inhibiting, oligomeric or polymeric component comprising:

a parent structure (GK) comprising at least two repeating monomer units (ME) and at least one uni- and/or multidentate, potentially anionic ligand (L) capable of forming complexes after the multicoat paint system has been thermally cured, wherein the monomer units (ME) are ethylenimines units and the ligand (L) is hydroxyacetophenone.

2. The multicoat paint system as of claim 1, wherein the basecoat material (A) and/or the basecoat material (B) is an aqueous basecoat material.

3. The multicoat paint system of claim 1, wherein binder (a.1) comprises at least two components selected from the group consisting of water-dilutable polyester resins (a.1.1), water-dilutable polyurethane resins (a.1.2), and water-dilutable polyacrylate resins (a.1.3).

4. The multicoat paint system of claim 1, wherein component (a.3) has a water-solubility or water-dispersibility at room temperature of at least 20 g/liter of water.

5. The multicoat paint system of claim 1, which is applied to at least one of (i) an unprimed metallic substrate, (ii) a metallic substrate provided at least partly with a primer (G).

6. The multicoat paint system of claim 1, wherein the binder (a.1) comprises a water-dilutable polyester resin (a.1.1), a water-dilutable polyurethane resin (a.1.2), and a water-dilutable polyacrylate resin (a.1.3).

7. The multicoat paint system of claim 1, wherein the parent structure (GK) comprises polyethylenimine having a weight-average molecular weight (Mw) of more than 500 Daltons.

8. A process for producing a multicoat paint system of claim 1 comprising:

(1) the at least one first color and/or effect basecoat comprising the aqueous basecoat material (A) of claim 1, (2) the second, color and/or effect basecoat comprising an aqueous basecoat material (B), and (3) the at least one transparent coating comprising a clearcoat material (C), the process comprising:

applying the basecoat materials (A) and (B) and the clearcoat material (C) to at least one substrate selected from the group consisting of:

(i) an unprimed substrate, (ii) a substrate coated with at least one uncured or partly cured primer (G), and (iii) a substrate coated with at least one fully cured primer (G), and jointly curing the wet films, comprising basecoat material (A), and basecoat material (B), and clearcoat material (C), and, optionally the uncured primer (G).

9. The process for producing a multicoat paint system of claim 8, wherein the basecoat materials (A) and (B) are applied at a wet film thickness such that curing results in a joint dry film thickness of the basecoat material (A) and of the basecoat material (B) of 10 to 50 μm.

10. The process for producing a multicoat paint system of claim 9, wherein the basecoat material (A) is applied with a wet film thickness such that curing results in a dry film thickness of the basecoat material (A) of 6 to 25 μm.

11. The process of claim 8, wherein the parent structure (GK) comprises polyethylenimine having a weight-average molecular weight (Mw) of more than 500 Daltons.

* * * * *